US010910738B2

(12) United States Patent
Vogel et al.

(10) Patent No.: US 10,910,738 B2
(45) Date of Patent: Feb. 2, 2021

(54) CABLE ASSEMBLY FOR COMMON MODE NOISE MITIGATION

(71) Applicant: CommScope, Inc. of North Carolina, Hickory, NC (US)

(72) Inventors: Mark O. Vogel, Statesville, NC (US); Mark E. Alrutz, Taylorsville, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 16/404,572

(22) Filed: May 6, 2019

(65) Prior Publication Data

US 2019/0372246 A1 Dec. 5, 2019

Related U.S. Application Data

(60) Provisional application No. 62/680,415, filed on Jun. 4, 2018.

(51) Int. Cl.
*H01R 9/05* (2006.01)
*H01R 24/28* (2011.01)
(Continued)

(52) U.S. Cl.
CPC ..... *H01R 9/0512* (2013.01); *H01R 9/0527* (2013.01); *H01R 24/28* (2013.01);
(Continued)

(58) Field of Classification Search
CPC .... H01R 9/0512; H01R 9/0527; H01R 24/28; H01R 24/40; H01R 27/02; H01R 2103/00;
(Continued)

(56) References Cited

U.S. PATENT DOCUMENTS 2,536,003 A * 12/1950 Dupre ..... H01R 9/0503 174/88 C
3,238,477 A 3/1966 Brueckmann
(Continued)

OTHER PUBLICATIONS

442C Grounding Module for AC and Coax with AC Outlet and Coax Cable Grounding, Advertisement by Tii Network Technologies, Inc., Dec. 2013, www.tiinetworktechnologies.com.
(Continued)

*Primary Examiner* — Travis S Chambers
(74) *Attorney, Agent, or Firm* — - Muncy, Geissler, Olds & Lowe, P.C.

(57) ABSTRACT

Common mode noise can exist on an outer conductor of a female F-type port of a RF-device, like a cable modem box or cable TV set-top box. The present invention utilizes a jumper wire attached to an electrically conductive connector, having a shape and size to fit around a base of the F-type female coaxial port. The jumper wire carries the common mode noise away from the outer conductor of the port. In a first embodiment, the jumper wire is connected to a ground line of a household outlet. In a second embodiment, the jumper wire dissipates the noise signal by interacting with one or more ferrites. In a third embodiment, the jumper wire carries the noise signal to a shielding layer of a coaxial cable, which may further carry the noise signal to one or more ferrites or a ground connection.

20 Claims, 10 Drawing Sheets

(51) Int. Cl.
*H01R 24/40* (2011.01)
*H01R 27/02* (2006.01)
*H01R 103/00* (2006.01)

(52) U.S. Cl.
CPC ..... *H01R 24/40* (2013.01); *H01R 27/02* (2013.01); *H01R 2103/00* (2013.01); *H01R 2201/18* (2013.01)

(58) Field of Classification Search
CPC .... H01R 2201/18; H01R 24/30; H01R 11/32; H01R 31/06; H01R 24/42
USPC ..... 439/92, 95, 96, 98, 99, 108, 502, 439/507–514, 578, 579, 497
See application file for complete search history.

(56) References Cited

U.S. PATENT DOCUMENTS 4,025,139 A * 5/1977 Martucci ..... H01R 13/648 439/106
4,325,598 A 4/1982 Leonardo
4,565,417 A * 1/1986 Dussel ..... H01R 13/52 439/108
4,579,405 A * 4/1986 Hirooka ..... H01R 9/2491 439/106
4,662,693 A * 5/1987 Hutter ..... H01R 12/775 439/314
4,691,081 A 9/1987 Gupta et al.
5,413,504 A 5/1995 Kloecker et al.
5,476,394 A 12/1995 Sugihara et al.
5,868,584 A * 2/1999 Cook ..... H01R 4/70 29/235
5,929,383 A 7/1999 Marik et al.
5,990,756 A 11/1999 France, Jr. et al.
6,184,471 B1 * 2/2001 Asakura ..... B23K 20/106 174/78
6,283,771 B1 9/2001 Mitchell et al.
6,710,673 B1 3/2004 Jokerst
6,843,664 B2 * 1/2005 Belson ..... H01R 13/719 439/105
7,114,990 B2 10/2006 Bence et al.
7,393,245 B2 7/2008 Palinkas et al.
7,708,592 B2 * 5/2010 Schnare ..... H01R 24/54 439/581
7,758,356 B2 7/2010 Burris et al.
8,758,050 B2 * 6/2014 Montena ..... H01R 24/38 439/578
8,888,527 B2 11/2014 Chastain et al.
8,915,751 B2 12/2014 Wood
9,022,799 B2 * 5/2015 Sorolla Rosario ... H01R 13/005 439/485
9,190,778 B2 * 11/2015 Harris ..... H01R 13/652
9,633,765 B2 * 4/2017 Natoli ..... H01R 4/029
9,960,541 B2 * 5/2018 Atkinson ..... H01R 4/4881
10,615,535 B2 * 4/2020 Watkins ..... H01R 13/622
2006/0227884 A1 * 10/2006 Koga ..... H04B 3/54 375/257
2007/0173099 A1 * 7/2007 Jenkinson ..... H01R 13/6395 439/352
2007/0298653 A1 12/2007 Mahoney et al.
2014/0162494 A1 6/2014 Holland
2014/0322968 A1 10/2014 Burns
2019/0074610 A1 * 3/2019 Thakare ..... H01R 9/0527
2019/0363753 A1 * 11/2019 Alkan ..... H04B 3/50

OTHER PUBLICATIONS

VK5ZVS—RF Choke, Projects 'n' Stuff, Another SPIRAT Initiative, 2009, www.prirat.com.au/vk5zvs/pic7.htm.
HF Antenna Line Isolator 1-30 MHz/Rated @3kW/BALUN/RF Choke CMC-130S-3K, May 8, 2018, Ebay Ad.
HF Choke Line Isolator 1.8-300 MHz, May 8, 2018, Ebay Ad.
RADIOWAVZ B11—ISO RADIOWAVZ BISO 1:1 Choke BALUN, May 8, 2018, Ebay Ad.
HF Choke 160-6 Meters Line Isolator, Ni4L Antennas & Electronics, May 8, 2018, Amazon.com Ad.

* cited by examiner

CABLE ASSEMBLY FOR COMMON MODE NOISE MITIGATION

This application claims the benefit of U.S. Provisional Application No. 62/680,415, filed Jun. 4, 2018, which is herein incorporated by reference.

BACKGROUND OF THE INVENTION

1. Field of the Invention

The present invention relates to cable modems and cable TV set-top boxes at subscriber locations. More particularly, the present invention relates to devices and methods to dissipate and/or eliminate noise on an outer conductor of a port of the F-type, so as to reduce and/or eliminate common mode noise on a center conductor of the F-type port and any coaxial cable attached thereto.

2. Description of the Related Art

Devices within a subscriber's premises, such as a cable modem box and cable television (CATV) set-top box, can generate radio frequency (RF) noise. Often the RF noise is coupled to the metal frame or housing of the box. The outer conductor of the device's RF input/output port, e.g., a female F-type port, is typically mounted directly to the metal frame or housing. Hence, the noise signal is present on the outer conductor of the F-type port.

The service provider signal is typically brought to the box by a coaxial cable terminated to male coaxial connector of the F-type. When the F-type connector is properly connected to the F-type port of the box, the RF noise, present on the outer conductor of the F-type port, transmits directly to the outer conductor of the coaxial cable terminated by the F-type connector. The RF noise does not degrade or interfere with Internet or CATV service signals carried on the center conductor of the coaxial cable, but rather gets carried along the outer conductor.

Sometimes, the F-type connector can have its center conductor engaged to the center conductor of the mating port, but the outer conductor of the F-type connector is not tightly coupled to the outer conductor of the F-type port. If the connection is sufficiently loose, such that contact between the outer conductors of the connector and port is lost, the noise signal on the outer conductor can transfer to the center conductor through a process called common mode coupling.

The loose connection may occur at the port of the modem box or CATV set-top box. However, there are many other points at which the common mode coupling can occur. For example, the cable connected to the customer's box, typically runs only a few feet to a wall plate with a female coaxial port and that connection may be loose. A first segment of cable runs from the backside of wall plate to a splitter, e.g., in the attic, a second segment of cable runs from the splitter to an amplifier, e.g., in the basement, a third segment of cable runs from the amplifier to a ground block on an outside wall of the subscriber's premises. Also, there are multiple cable segments that run from the amplifier and/or splitter to other wall outlets and other RF devices. Hence, if noise is traveling on the outer conductor of the coaxial cable and it encounters any loose couplings along the various segments/paths, common mode coupling can occur, and noise can jump from the outer conductor to the center conductor of the coaxial cable.

After common mode coupling, the noise signal will travel on the center conductor of the cable. If the noise is in the frequency band of the operational frequencies used in the network, or has a harmonic in that frequency band, the noise can interfere with and degrade the quality of, and thus performance of, the provided services, e.g., Internet, phone, entertainment programming.

This problem could be addressed with a re-design of the customer's modem box or CATV set-top box. For example, general noise suppression circuitry could be added within the box and/or of the RF input port could be isolated from the noise sources. Some newer customer boxes have employed these measures to deal with the noise issues. However, a significant number of older boxes are still in deployment, e.g., perhaps more than thirty million boxes, and it is too expensive to do a large scale change out of potentially problematic boxes, which produce noise on the outer conductor of the RF port. What is needed is a solution that can be applied to the currently deployed customer boxes in a manner that does not require entry into the housings of customer boxes. Entry into the housing and making modifications to internal circuitry would be so time consuming that it would probably be more economical to replace the customer boxes.

SUMMARY OF THE INVENTION

It is an object of the present invention to address the drawbacks of the background art, as noted above. The Applicant has invented solutions to the problem of common mode coupling of noise from the outer conductor of the F-type port to the center conductor of the F-type port and/or a center conductor of a coaxial cable attached to the F-type port.

These and other objects are accomplished by an apparatus comprising: a power cord including: three insulated electrical conductors within a jacket; a male outlet plug having two blades and a ground pin for mating to a standard 110 volt AC outlet receptacle, disposed at a first end of said power cord; a power plug having first and second electrical leads electrically connected to first and second insulated electrical conductors of said three insulated electrical conductors within said jacket, respectively, said power plug being disposed at a second end of said power cord and adapted to provide alternating current (AC) power to a power port of a radio frequency (RF) device; an electrically conductive connector having a shape and size to fit around a base of a F-type female coaxial port and make electrical contact with the outer conductor of the F-type female coaxial port; and a jumper wire, wherein said electrically conductive connector is electrically connected to a first end of said jumper wire, wherein a second end of said jumper wire is electrically connected to a third insulated electrical conductor of said three insulated electrical conductors within said jacket, and wherein said third insulated electrical conductor is electrically connected to said ground pin of said male outlet plug.

Moreover, these and other objects are accomplished by an apparatus comprising: a coaxial cable segment including: an inner conductor; a dielectric layer surrounding said inner conductor; an outer conductor surrounding said dielectric layer; a jacket surrounding said outer conductor; and a male F-type coaxial connector attached to a first end of said coaxial cable segment; an electrically conductive connector having a shape and size to fit around a base of a F-type female coaxial port and make electrical contact with the outer conductor of the F-type female coaxial port; and a jumper wire, wherein said electrically conductive connector is electrically connected to a first end of said jumper wire, and wherein another portion of said jumper wire is in electrical contact with said outer conductor of said coaxial cable segment.

Further still, these and other objects are accomplished by an apparatus comprising: a coaxial cable segment including: an inner conductor; a dielectric layer surrounding said inner conductor; an outer conductor surrounding said dielectric layer; a jacket surrounding said outer conductor; a male F-type coaxial connector attached to a first end of said coaxial cable segment; one or more ferrite members mounted to a portion of said coaxial cable segment; and an electrically conductive connector having a shape and size to fit around a base of a F-type female coaxial port and make electrical contact with the outer conductor of the F-type female coaxial port; and a jumper wire, wherein said electrically conductive connector is electrically connected to a first end of said jumper wire, and wherein a second end of said jumper wire is routed to electrically interact with said one or more ferrite members so as to dissipate any radio frequency noise to said one or more ferrite members.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limits of the present invention, and wherein.

DETAILED DESCRIPTION OF EMBODIMENTS OF THE INVENTION

Figure 1:
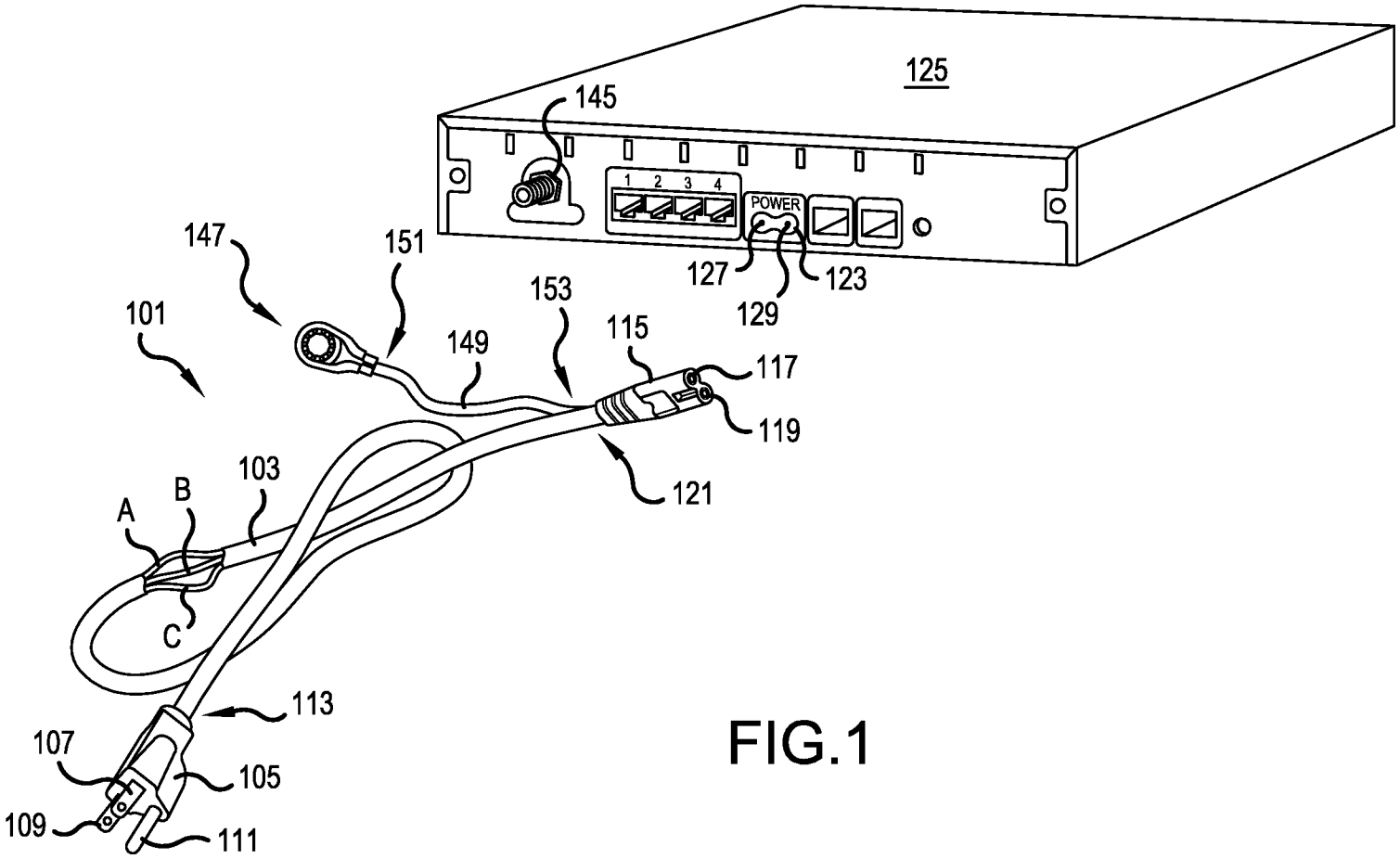
FIG. 1 is a rear perspective view of an apparatus in accordance with a first embodiment of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

FIG. 1 is a rear perspective view of an apparatus in accordance with a first embodiment of the present invention. The first embodiment includes a power cord 101 having first, second and third insulated electrical conductors A, B and C within a jacket 103. A male outlet plug 105 is disposed at a first end 113 of the power cord 101. The male outlet plug 105 has two blades 107 and 109 and a ground pin 111 for mating to a standard 110 volt AC outlet receptacle. The two blades 107 and 109 are connected to the first and second insulated electrical conductors A and B, respectively, and the ground pin 111 is connected to the third insulated electrical conductor C.

A power plug 115 is disposed at a second end 121 of the power cord 101. The power plug 115 has first and second electrical leads 117 and 119 electrically connected to the first and second insulated electrical conductors A and B, respectively. The power plug 115 is adapted to provide alternating current (AC) power to a power port 123 of a radio frequency (RF) device.

In a first embodiment as depicted in FIG. 1, the RF device is a cable modem box 125. The power port 123 of the cable modem box 125 has first and second electrical terminals 127 and 129 to electrically connect with the first and second electrical leads 117 and 119 of the power plug 115, respectively. It should be noted that the power port 123 of the cable modem box 125 does not include a ground terminal and does not establish electrical contact with the third insulated electrical conductor C, which is attached to the ground pin 111.

Figure 2:
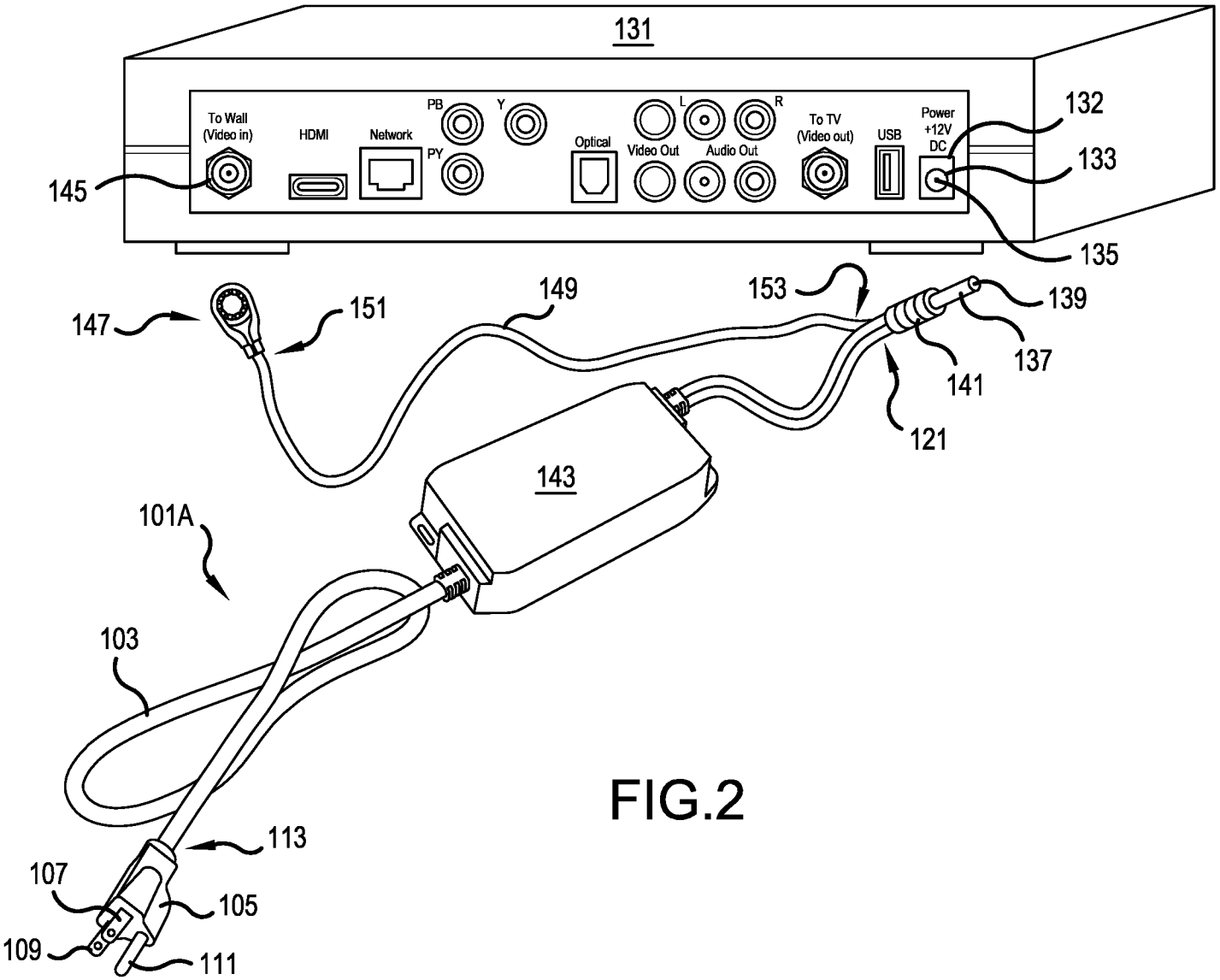
FIG. 2 is a rear perspective view of an apparatus in accordance with a second embodiment of the present invention.

In a second embodiment as depicted in FIG. 2, the RF device is a CATV set-top box 131. A power port 132 of the CATV set-top box 131 has first and second electrical terminals 133 and 135 to electrically connect with first and second electrical leads 137 and 139 of a power plug 141, respectively. It should be noted that the power port 132 of the CATV set-top box 131 does not include a ground terminal and does not establish electrical contact with the third insulated electrical conductor C, which is attached to the ground pin 111 of the power cord 101A.

In the first embodiment of FIG. 1, i.e., the cable modem box 125, the power plug 115 is configured in accordance with the IEC320 CY standard, and supplies AC power to the power port 123. For example, the first and second electrical leads 117 and 119 of the power plug 115 are formed as first and second sleeves to receive the first and second electrical terminals 127 and 129 of the power port 123, which are formed as first and second pins.

In the second embodiment of FIG. 2, i.e., the CATV set-top box 131, the power plug 141 is configured as a barrel-type plug and supplies DC power to the power port 132. The AC power received by the male outlet plug 105 is converter into DC power by a transformer 143. Of course, the transformer 143 could be integrated into the male outlet plug to form a wall adapter 143A, as shown in FIG. 3.

Figure 3:
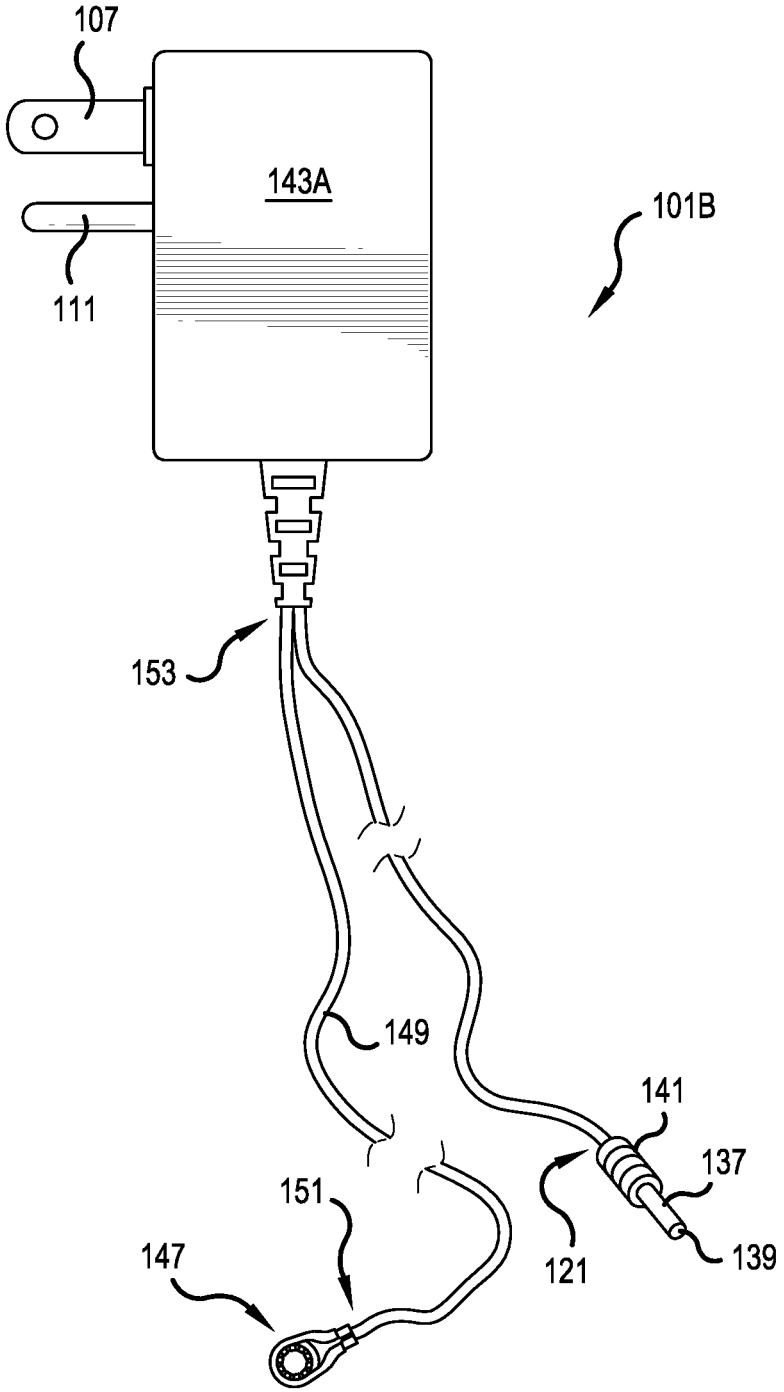
FIG. 3 is a side view of an alternative power cord for use with the embodiment of FIG. 2.

The barrel-type plug 141 of FIGS. 2 and 3 may be formed by the first and second electrical leads 137 and 139 being formed as an outer conductive sleeve separated from an inner conductive sleeve by an insulation layer. The inner conductive sleeve receives the second electrical terminal 135 which may take the form of a center pin. The outer conductive sleeve abuts the first electrical terminal 133 which may take the form of a tab being spring biased toward the second electrical terminal 135.

In both of the first and second embodiments, the cable modem box 125 or the CATV set-top box 131 includes a F-type female coaxial port 145. Also, in both of the first and second embodiments, an electrically conductive connector 147 has a shape and size to fit around a base of the F-type female coaxial port 145 and make electrical contact with an outer conductor of the F-type female coaxial port 145.

A jumper wire 149 is electrically connected to the electrically conductive connector 147. More specifically, a first end 151 of the jumper wire 149 is connected to the electrically conductive connector 147 and a second end 153 of the jumper wire 149 is electrically connected to the third insulated electrical conductor C of the three insulated electrical conductors A, B and C within the jacket 103. As previously mentioned, the third insulated electrical conductor C is electrically connected to the ground pin 111 of the male outlet plug 105. The jumper wire 149 may having an outer insulation layer, or may be a bare wire. It may also be formed of stranded plural wires or a solid conductor.

Figure 4:
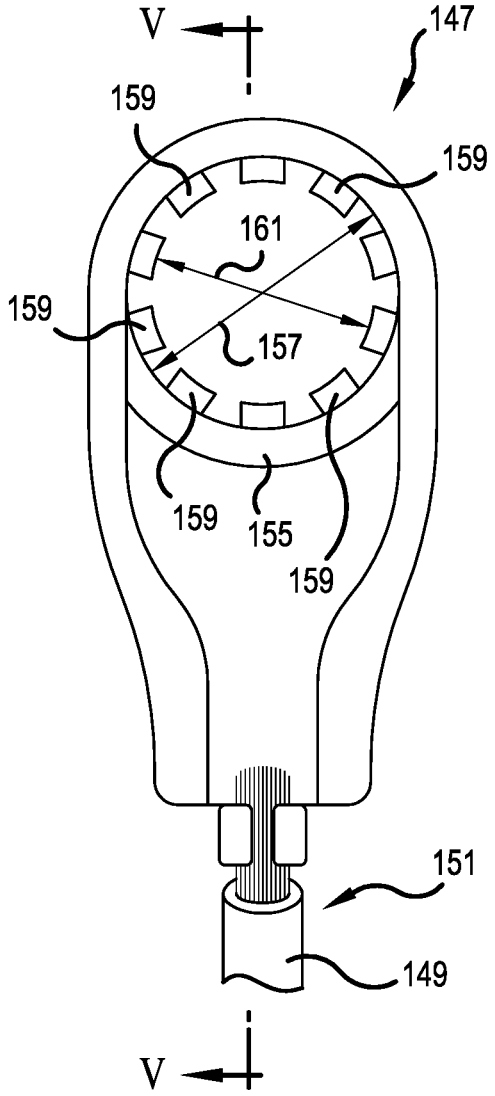
FIG. 4 is a close-up view of an electrically conductive connector of FIGS. 1-3.
Figure 5:
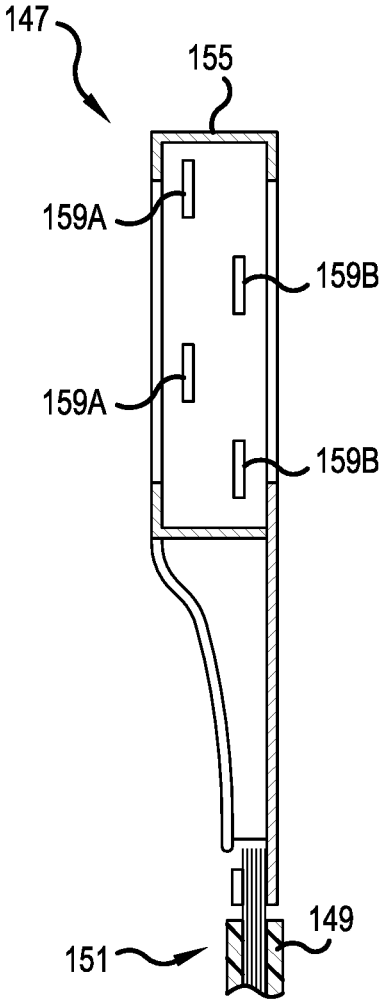
FIG. 5 is a cross sectional view taken along line V-V in FIG. 4.

FIG. 4 is a close-up view of the electrically conductive connector 147, and FIG. 5 is a cross sectional view taken along line V-V in FIG. 4. The electrically conductive connector 147 is formed as a ring 155 of conductive metal having an inner diameter 157, which is slightly greater than an outer diameter of the F-type female coaxial port 145. A plurality of teeth 159 extend inwardly from said ring 155 with inner ends facing a center of said ring, and wherein a diameter 161 of the inner ends of the plurality of teeth 159 is slightly less than the outer diameter of the F-type female coaxial port 145.

The plurality of teeth 159 are resilient and flexible and engage with threads formed on the outer surface of the F-type female coaxial port 145. As best seen in FIG. 5, the teeth 159 are formed in at least two rows 159A and 159B. Each row is angled to correspond to the angle of the outer threads on the F-type female coaxial port 145. The teeth 159 lockingly engage with threads formed on the outer surface of the F-type female coaxial port 145. In practice, the electrically conductive connector 147 may be pressed onto the F-type female coaxial port 145, while the plurality of teeth 159 snap past the existing threads on the F-type female coaxial port 145. Once the electrically conductive connector 147 resides at the base of the F-type female coaxial port 145, the second row of teeth 159B reside with the thread channel at the base of the F-type female coaxial port 145 and the first row of teeth 159A reside with the second thread channel next to the base of the F-type female coaxial port 145. A thin nut (not shown) may be threaded onto the F-type female coaxial port 145 to tightly secure the electrically conductive connector 147 to the F-type female coaxial port 145.

Figure 6:
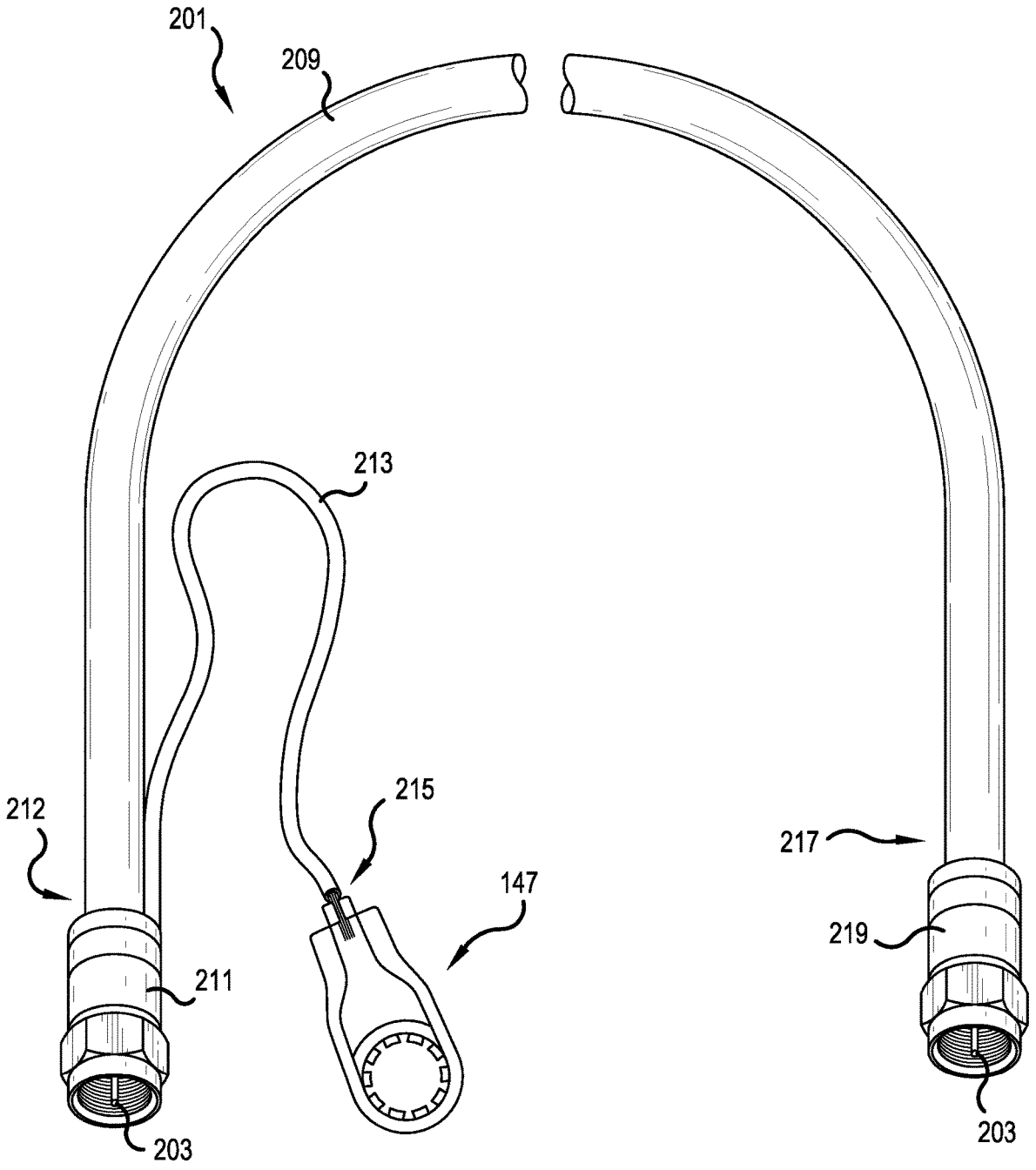
FIG. 6 is a front perspective view of an apparatus in accordance with a third embodiment of the present invention.
Figure 7:
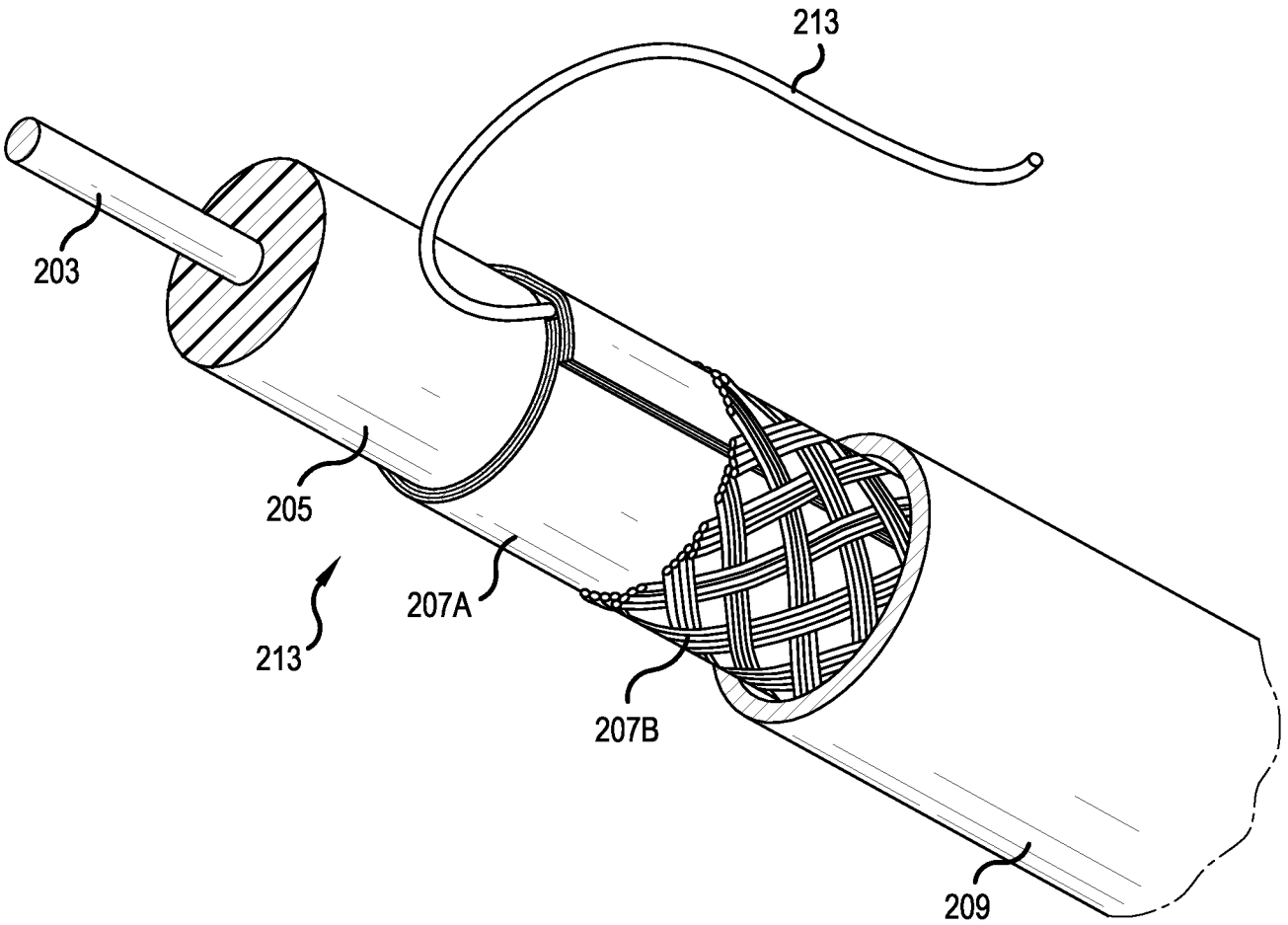
FIG. 7 is a front perspective view of an end of a coaxial cable segment prior to an assembly process.

FIG. 6 is a front perspective view of an apparatus in accordance with a third embodiment of the present invention. The second embodiment includes a coaxial cable segment 201. FIG. 7 is a perspective view of an end of the coaxial cable segment 201 prior to an assembly process.

The coaxial cable segment 201 has an inner conductor 203. A dielectric layer 205, best seen in FIG. 7, surrounds the inner conductor 203. An outer conductor 207A and 207B surrounds the dielectric layer 205. In FIG. 7, the outer conductor 207A and 207B is formed of a first layer 207A constructed of a conductive foil and a second layer 207B formed of braided conductive wires. However, a single layer outer conductor is within the purview of the present invention. A jacket 209 surrounds the outer conductor 207A and 207B. A first male F-type coaxial connector 211 is attached to a first end 212 of the coaxial cable segment 201.

The electrically conductive connector 147, having a shape and size to fit around the base of the F-type female coaxial port 145 and make electrical contact with the outer conductor of the F-type female coaxial port 145, is also provided in the third embodiment. In the third embodiment, a first end 215 of a jumper wire 213 is attached to, and in electrical contact with, the electrically conductive connector 147. Another portion of the jumper wire 213 is in electrical contact with the outer conductor 207A and 207B of the coaxial cable segment 201.

As best seen in FIG. 7, the jumper wire 213 may be formed from a drain wire 213. The drain wire 213 is a bare wire, disposed within the jacket 209, and is in electrical contact with the outer conductor 207A and 207B of the coaxial cable segment 201 over the entire length of the coaxial cable segment 201. To make the jumper wire 213 sufficiently long, e.g., nine inches long, the technician removes a long length, e.g., ten inches, of the jacket 209, outer conductor 207A and 207B, dielectric layer 205, and inner conductor 203. Then, the technician terminates the end of the coaxial cable segment 201 with the first male F-type coaxial connector 211 in a traditional manner, while folding the retained length of drain wire 213 back along the jacket 209.

As shown in FIG. 6, a second end 217 of the coaxial cable segment 201 may be terminated by a second male F-type coaxial connector 219. However, it is often advantageous to terminate the second end 217 of the coaxial cable segment 201 with a female F-type coaxial connector 221, as best seen in FIG. 8.

Figure 8:
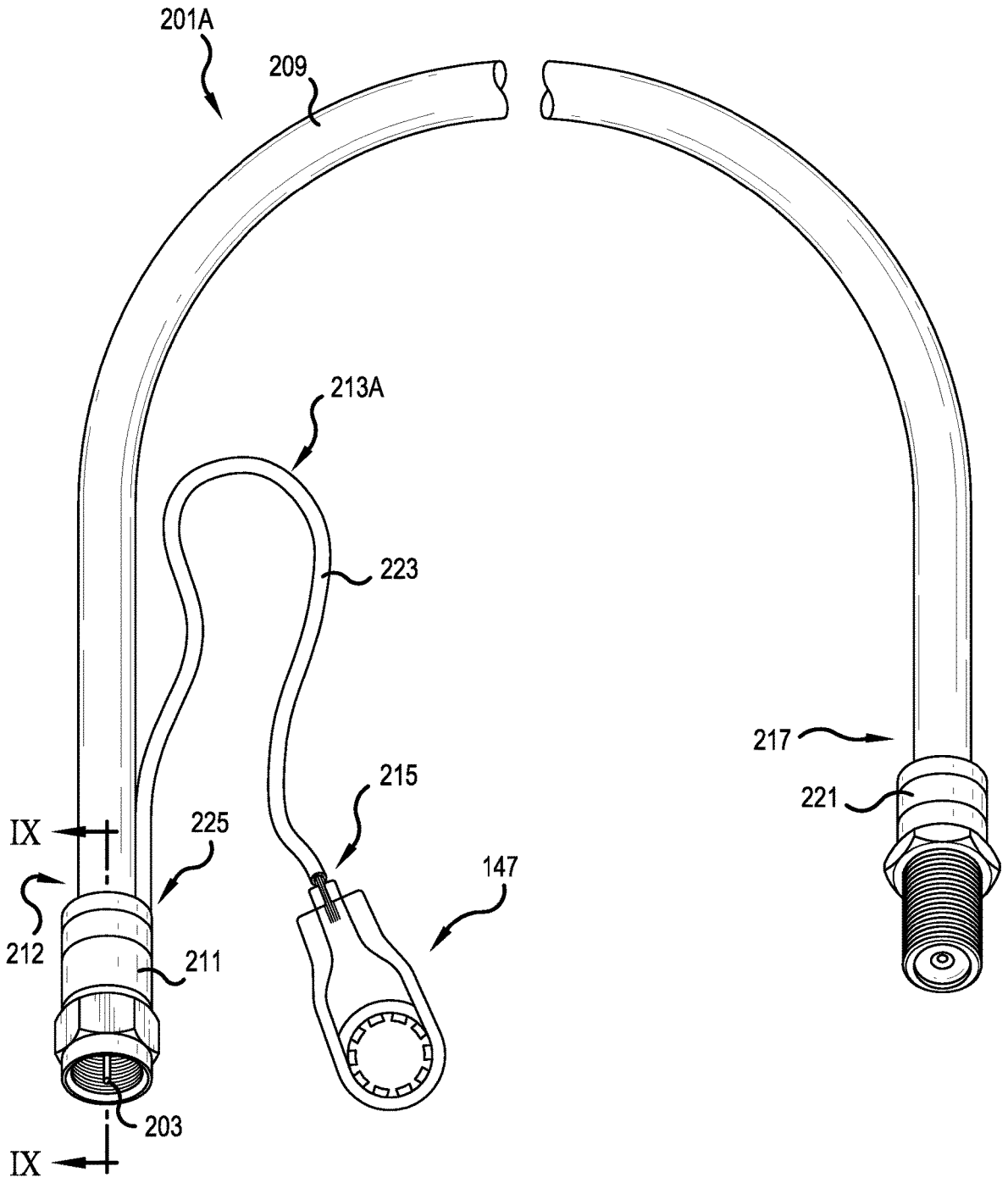
FIG. 8 is a front perspective view of a modified embodiment, similar to FIGS. 6 and 7.
Figure 9:
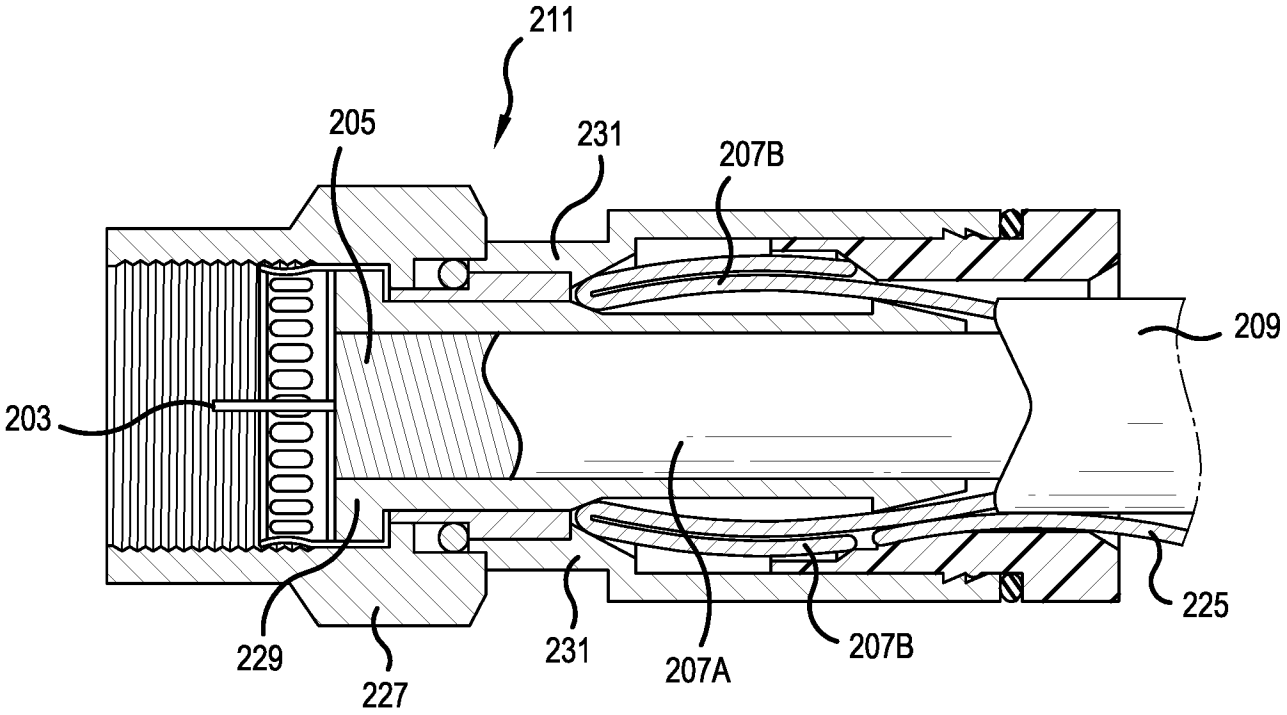
FIG. 9 is a cross sectional view taken along line IX-IX in FIG. 8.

FIG. 8 is a front perspective view of a modified embodiment of FIGS. 6 and 7. FIG. 9 is a cross sectional view taken along line IX-IX in FIG. 8. The modified embodiment of FIG. 8 is very similar to the embodiment of FIGS. 6 and 7 except that the second male F-type coaxial connector 219 has been replaced by the female F-type coaxial connector 221, the coaxial cable segment 201A does not include a drain wire 213, and the jumper wire 213A has an insulation jacket 223.

In FIGS. 8 and 9, the jumper wire 213A is a segment of insulated wire with the first end 215 terminated to the electrically conductive connector 147. A second end 225 of the jumper wire 213A is inserted into the coaxial cable segment 201A proximate the first end 212 of the coaxial cable segment 201A, or into the first male F-type coaxial connector 211 to establish electrical contact with said outer conductor 207A and 207B of the coaxial cable segment 201A.

As best seen in FIG. 9, the second end 225 of the jumper wire 213A is directly connected to a portion of the first male F-type coaxial connector 211. The first male F-type coaxial connector 211 includes a nut 227 at its distal end to attach to the F-type female coaxial port 145. A body 229 rotatably supports the nut 227. A boot 231 at a proximal end of the first male F-type coaxial connector 211 covers a transition between the body 229 and the jacket 209 of the coaxial cable segment 201A.

The second end 225 of the jumper wire 213A passes into the boot 231 and is electrically connected to the body 229 of the first male F-type coaxial connector 211. In other words, the jumper wire 213A is placed into electrical contact with the outer conductor 207A and 207B of the coaxial cable segment 201A by a direct connection to the first male F-type coaxial connector 211, and/or may also directly contact the outer conductor 207A and 207B of the coaxial cable segment 201A, within the first male F-type coaxial connector 211, as also shown in FIG. 9. Additional details concerning the construction of the first male F-type coaxial connector 211 can be found in the Assignee's prior U.S. Pat. No. 8,915,751, which is herein incorporated by reference.

Figure 10:
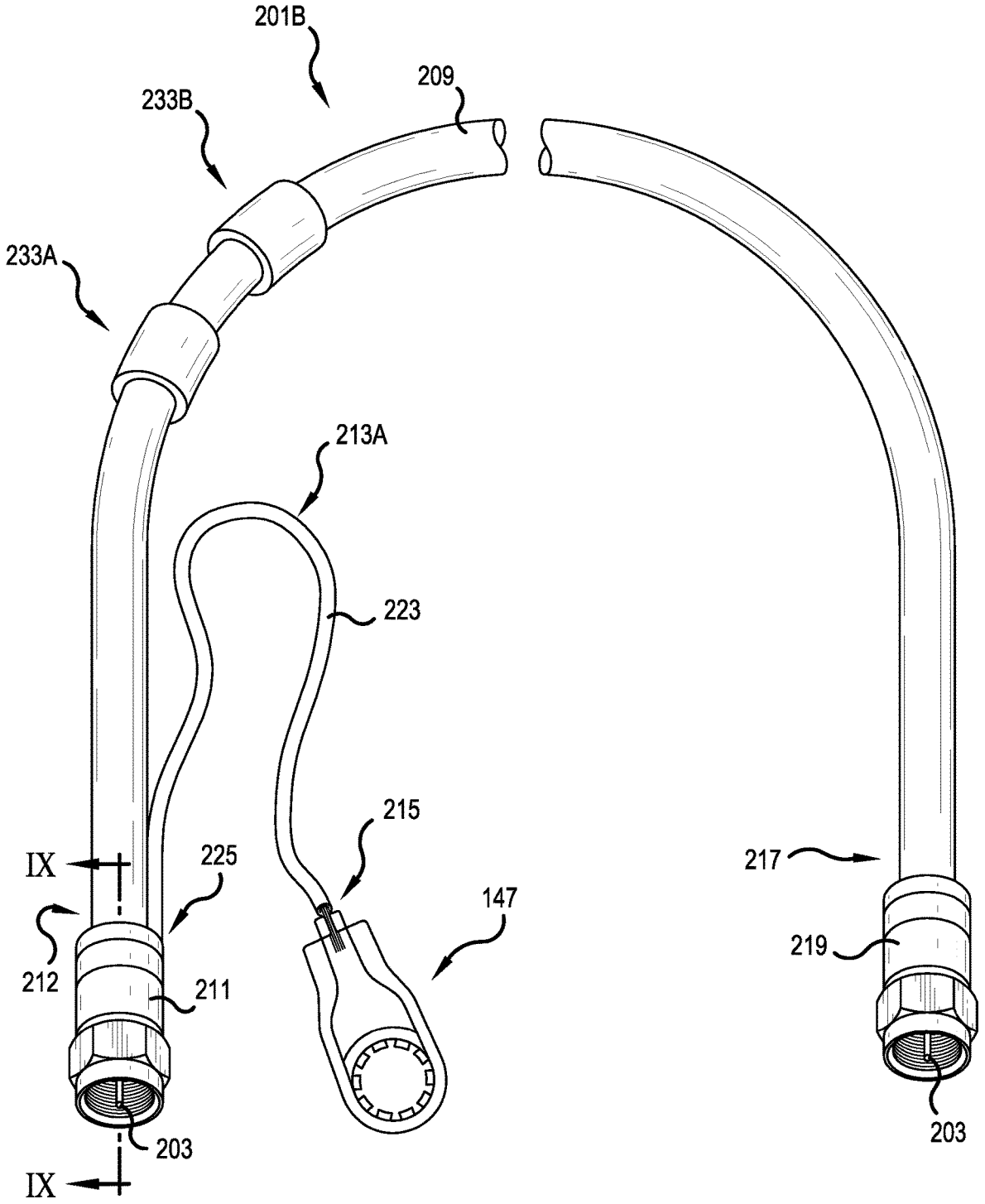
FIG. 10 is a front perspective view of an apparatus in accordance with a fourth embodiment of the present invention.

FIG. 10 is a front perspective view of a fourth embodiment of the present invention. The fourth embodiment of FIG. 10 is very similar to the embodiment of FIGS. 8 and 9 except that the female F-type coaxial connector 221 has been replaced by the second male F-type coaxial connector 219, and one or more ferrite members 233A and 233B are mounted to a portion of the coaxial cable segment 201B.

In FIG. 10, first and second ferrite members 233A and 233B are mounted near a mid-portion of the coaxial cable segment 201B. The one or more ferrite members 233A and 233B encircle a portion of the coaxial cable segment 201B. A portion of the jacket 209 is removed at the encircled portion of the coaxial cable segment 201B where ferrite members 233A and 233B are mounted, so that the ferrite members 233A and 233B are in electrical contact with the outer conductor 207A and 207B. A heat shrink wrap or over jacket may be used to seal the ferrite members 207A and 207B to the jacket 209 of the coaxial cable segment 201B.

In the embodiment of FIG. 10, the second end 225 of the jumper wire 213A routes electrical noise to the first male F-type coaxial connector 211. The electrical noise then travels on the outer conductor 207A and 207B of the coaxial cable segment 201B to electrically interact with the one or more ferrite members 233A and 233B, so as to dissipate the electrical noise to the one or more ferrite members 233A and 233B.

Figure 11:
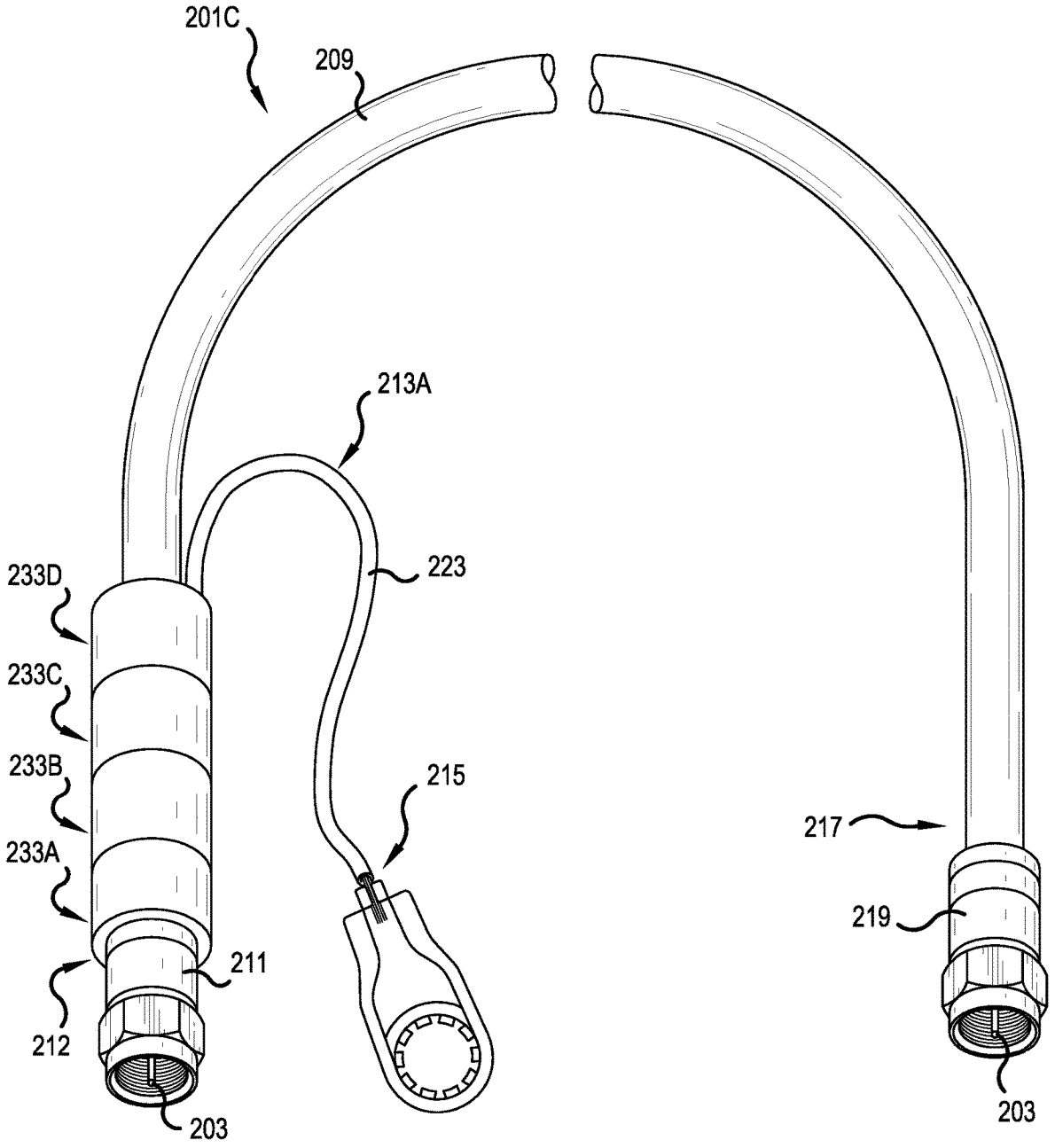
FIG. 11 is a front perspective view of an apparatus in accordance with a fifth embodiment of the present invention.

FIG. 11 is a front perspective view of a fifth embodiment of the present invention. The fifth embodiment of FIG. 11 is very similar to the embodiment of FIG. 10 except that the one or more ferrite members 233A, 233B, 233C and 233D are mounted to a portion of the coaxial cable segment 201C closer to the first end 212. Also, the jumper wire 213A is looped one or more times through the one or more ferrite members 233A, 233B, 233C and 233D prior to being placed into electrical contact with the outer conductor 207A and 207B of the coaxial cable segment 201B and/or being terminated to the body 229 and/or the boot 231 of the first male F-type coaxial connector 211. Looping the jumper wire 213A through the one or more ferrite members 233A, 233B, 233C and 233D allows the electrical noise to interact with the one or more ferrite members 233A, 233B, 233C and 233D more times, so as to better dissipate the electrical noise.

Instead of relying upon the one or more ferrite members 233, it is also within the purview of the present invention to simply couple the electrical noise from the jumper wire 213, 213A onto the outer conductor 207A and 207B and reply upon the grounding block of the customer's residence to eliminate the electrical noise being carried by the outer conductor 207A and 207B. However, the previously described embodiments of FIGS. 6-11 are preferred as the electrical noise is quickly dissipated after the customer's box 125, 131 before encountering any loose connections further downstream, i.e., before the ground block, where common mode couple may occur.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

The invention claimed is:

1. An apparatus comprising:

a power cord including:

three insulated electrical conductors within a jacket;

a male outlet plug having two blades and a ground pin for mating to a standard 110 volt AC outlet receptacle, disposed at a first end of said power cord;

a power plug having first and second electrical leads electrically connected to first and second insulated electrical conductors of said three insulated electrical conductors within said jacket, respectively, said power plug being disposed at a second end of said power cord and adapted to provide alternating current (AC) power to a power port of a radio frequency (RF) device;

an electrically conductive connector having a shape and size to fit around a base of a F-type female coaxial port and make electrical contact with the outer conductor of the F-type female coaxial port, while leaving said F-type female coaxial port open to mate with a male F-type coaxial connector; and a jumper wire, wherein said electrically conductive connector is electrically connected to a first end of said jumper wire, wherein a second end of said jumper wire is electrically connected to a third insulated electrical conductor of said three insulated electrical conductors within said jacket, and wherein said third insulated electrical conductor is electrically connected to said ground pin of said male outlet plug, wherein said electrically conductive connector is formed as a flat conductive metal piece with an opening slightly greater than an outer surface of the F-type female coaxial port, and wherein said flat conductive metal piece engages said outer surface of said F-type female coaxial power proximate said base of said F-type female coaxial port.

2. An apparatus according to claim 1, wherein said power plug is configured in accordance with the IEC320 CY standard.

3. An apparatus according to claim 1, further comprising:

a CATV set top box constituting said RF device, wherein said CATV set top box includes said F-type female coaxial port and said power port, and wherein said power port of said CATV set top box has first and second electrical terminals electrically connected with said first and second electrical leads of said power plug, respectively.

4. An apparatus according to claim 1, further comprising:

a modem constituting said RF device, wherein said modem includes said F-type female coaxial port and said power port, and wherein said power port of said modem has first and second electrical terminals electrically connected with said first and second electrical leads of said power plug, respectively.

5. An apparatus according to claim 4, wherein said power port of said modem does not include a ground terminal and does not establish electrical contact with said third insulated electrical conductor of said three insulated electrical conductors within said jacket.

6. An apparatus according to claim 1, wherein said electrically conductive connector is formed as a ring of conductive metal having an inner diameter, which is slightly greater than an outer diameter of the F-type female coaxial port, wherein a plurality of teeth extend inwardly from said ring with inner ends facing a center of said ring, and wherein a diameter of said inner ends of said plurality of teeth is slightly less than the outer diameter of the F-type female coaxial port, so that said inner ends of said plurality of teeth engage said outer surface of said F-type female coaxial port proximate said base of said F-type female coaxial port.

7. An apparatus according to claim 6, wherein said plurality of teeth are resilient and flexible and engage with threads formed on said outer surface of the F-type female coaxial port.

8. An apparatus according to claim 6, wherein said plurality of teeth are formed in at least two rows and are angled to lockingly engage with threads formed on said outer surface of the F-type female coaxial port proximate said base of said F-type female coaxial port.

9. An apparatus comprising:

a coaxial cable segment including:

an inner conductor;

a dielectric layer surrounding said inner conductor;

an outer conductor surrounding said dielectric layer;

a jacket surrounding said outer conductor;

a male F-type coaxial connector attached to a first end of said coaxial cable segment;

an electrically conductive connector having a shape and size to fit around a base of a F-type female coaxial port and make electrical contact with the outer conductor of the F-type female coaxial port, while leaving the F-type female coaxial port open, such that both said electrically conductive connector and said male F-type coaxial connector may be simultaneously mated to the same F-type female coaxial port; and a jumper wire, wherein said electrically conductive connector is electrically connected to a first end of said jumper wire, and wherein another portion of said jumper wire is in electrical contact with said outer conductor of said coaxial cable segment.

10. The apparatus according to claim 9, wherein said jumper wire is a drain wire, and wherein said drain wire is disposed within said jacket and is in electrical contact with said outer conductor of said coaxial cable segment over the entire length of said coaxial cable segment.

11. The apparatus according to claim 9, wherein said jumper wire is a segment of wire which has a second end, wherein said second end of said jumper wire is inserted into said coaxial cable segment proximate said first end of said coaxial cable segment to establish electrical contact with said outer conductor of said coaxial cable segment.

12. The apparatus according to claim 9, wherein a second end of said jumper wire is directly connected to a portion of said male F-type coaxial connector.

13. The apparatus according to claim 9, wherein said male F-type coaxial connector is a first male F-type coaxial connector, and further comprising:

a second male F-type coaxial connector attached to a second end of said coaxial cable segment.

14. The apparatus according to claim 9, further comprising:

a female F-type coaxial connector attached to a second end of said coaxial cable segment.

15. An apparatus comprising:

a coaxial cable segment including:

an inner conductor;

a dielectric layer surrounding said inner conductor;

an outer conductor surrounding said dielectric layer;

a jacket surrounding said outer conductor;

a male F-type coaxial connector attached to a first end of said coaxial cable segment;

one or more ferrite members mounted to a portion of said coaxial cable segment;

an electrically conductive connector having a shape and size to fit around a base of a F-type female coaxial port and make electrical contact with the outer conductor of the F-type female coaxial port; and a jumper wire, wherein said electrically conductive connector is electrically connected to a first end of said jumper wire, and wherein a second end of said jumper wire is routed to electrically interact with said one or more ferrite members so as to dissipate any radio frequency noise to said one or more ferrite members.

16. The apparatus according to claim 15, wherein said one or more ferrite members encircle said portion of said coaxial cable segment where said one or more ferrite members are mounted, and wherein a portion of said jacket is removed at said portion of said coaxial cable segment where said one or more ferrite members are mounted, and wherein said one or more ferrite members are in electrical contact with said outer conductor.

17. The apparatus according to claim 15, wherein said male F-type coaxial connector includes a nut at its distal end to attached to the F-type female coaxial port, and a body rotatably supporting said nut, and a boot at a proximal end of said male F-type coaxial connector to cover a transition between said body and said jacket of said coaxial cable segment, and wherein said jumper wire passed into said boot and is electrically connected to said body of said male F-type coaxial connector.

18. The apparatus according to claim 15, wherein said electrically conductive connector is formed as a ring of conductive metal having an inner diameter, which is slightly greater than an outer diameter of the F-type female coaxial port, wherein a plurality of teeth extend inwardly from said ring with inner ends facing a center of said ring, and wherein a diameter of said inner ends of said plurality of teeth is slightly less than the outer diameter of the F-type female coaxial port.

19. The apparatus according to claim 15, wherein said jumper wire is looped one or more times through said one or more ferrite members prior to being placed into electrical contact with said outer conductor of said coaxial cable segment.

20. The apparatus according to claim 19, wherein said jumper wire is placed into electrical contact with said outer conductor of said coaxial cable segment by a direct connection to said male F-type coaxial connector.

* * * * *